US006922927B1

(12) United States Patent
Harmon

(10) Patent No.: US 6,922,927 B1
(45) Date of Patent: Aug. 2, 2005

(54) HOLDER FOR AND METHOD FOR HOLDING MEMORIAL MATERIAL

(76) Inventor: David Harmon, 1075 Preserve Ave., Apt 3-211, Naperville, IL (US) 60564

( * ) Notice: Subject to any disclaimer, the term of this patent is extended or adjusted under 35 U.S.C. 154(b) by 0 days.

(21) Appl. No.: 10/461,213

(22) Filed: Jun. 16, 2003

(51) Int. Cl.[7] ..... G09F 19/00
(52) U.S. Cl. ..... 40/124.5; 40/607.05; 434/378; 52/103; D99/18
(58) Field of Search ..... 40/607.05, 607.06, 40/124.5; 434/378; 52/103; D99/18, 19

(56) References Cited

U.S. PATENT DOCUMENTS 1,504,565 A * 8/1924 McNeill ..... 40/124.5
1,885,136 A * 11/1932 Pereau ..... 40/124.5
1,926,468 A * 9/1933 Vogelpohl ..... 40/124.5
3,503,163 A * 3/1970 Lutz ..... 52/103
4,894,937 A * 1/1990 Davis ..... 40/607.06

* cited by examiner

*Primary Examiner*—Gary C. Hoge
(74) *Attorney, Agent, or Firm*—Thomas L. Adams

(57) ABSTRACT

A holder for memorial material includes a display panel with a front and rear surface, and an upper ledge attached to the display panel. The display panel has between the front surface and the rear surface a material space for the memorial material. One can insert the memorial material into the internal material space inside the display panel. The upper ledge is adapted to receive downward pressure of a magnitude sufficient to drive the display panel at least partially underground. The display panel also has right and left converging edges to facilitate the at least partial underground burial.

33 Claims, 2 Drawing Sheets

FIG. 3
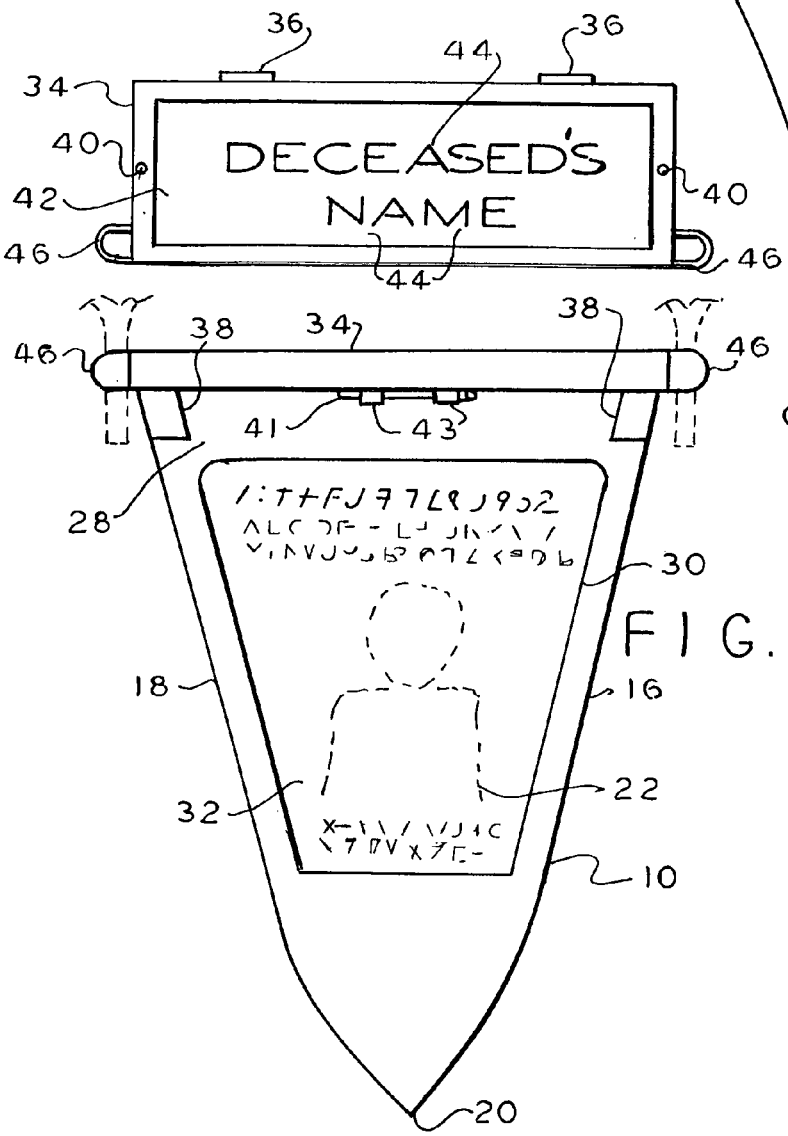
FIG. 2
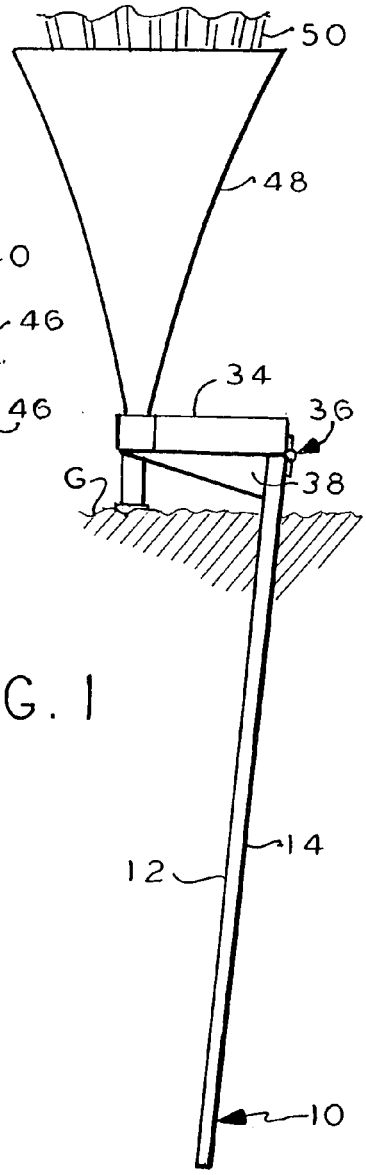
FIG. 1
FIG. 4
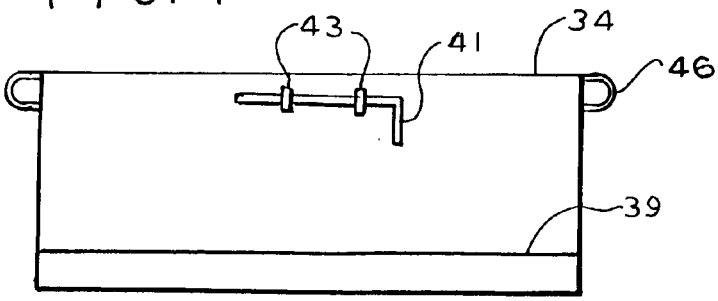

FIG. 5
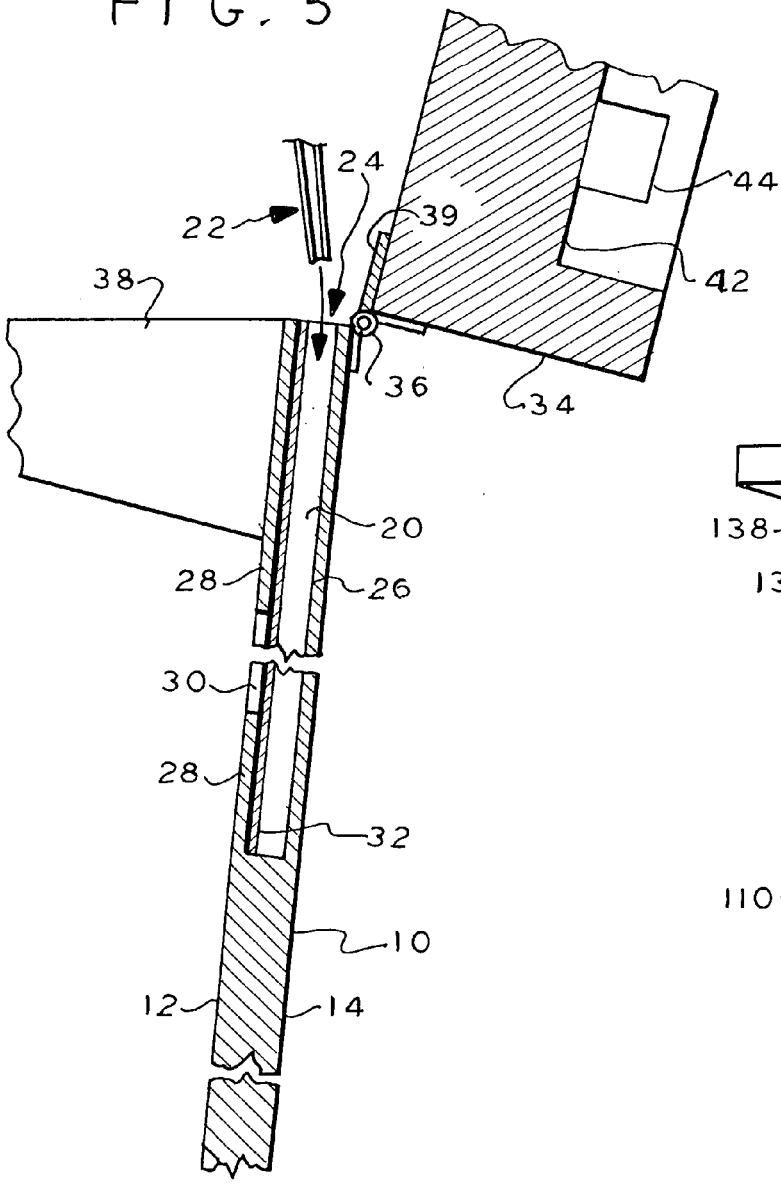
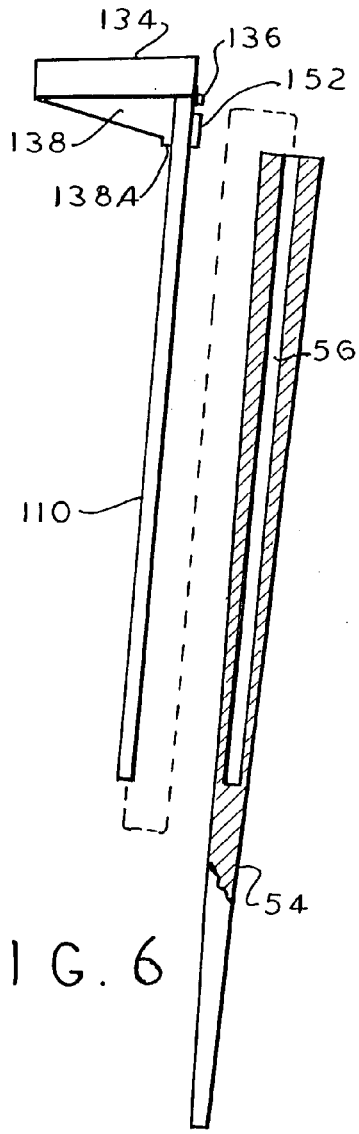
FIG. 6

HOLDER FOR AND METHOD FOR HOLDING MEMORIAL MATERIAL

BACKGROUND OF THE INVENTION

1. Field of the Invention

The present invention relates to holders for memorial materials, including methods for driving the holders at least partially underground.

2. Description of Prior Art

People like to leave memorial material at gravesites, such as pictures of the deceased, messages to or about the deceased, flowers etc. These memorial materials need to be secured against wind, weather, theft, and inadvertent scattering or removal done intentionally or unintentionally by other people. Also, graveyard operators may have regulations regarding material that may be left at gravesites in order to avoid the accumulation of litter and to avoid interference with lawn maintenance. In particular, material that is held in place by stakes may constitute a hazard or obstruction for lawn mowers.

Also, one should be able to place such memorial material without carrying tools. For example, it is desirable to secure the memorial material without the need for hammers, shovels, and the like. Also, the memorial material should be protected from the elements and yet still be easily replaced, again without the need for carrying tools to the gravesite.

In U.S. Pat. No. 3,608,220 a curved backplate 6 is attached to a stake 3. A memorial card 18 inside a clear envelope 28 is inserted in the diagonal slots 19 of cardholder 14, which is mounted on backplate 6. This assembly is covered with front plate 21.

In U.S. Pat. No. 2,017,335 a memorial message is placed behind a transparent window 6 in a front plate 1. A backer plate 8 is placed behind the message and the front plate 1 is bolted to stake 10.

In U.S. Pat. No. 1,310,369 a memorial card is placed behind a glass pane 9 that is sandwiched between two sheet metal panels that are soldered together. A stake 1 is attached to the back of the assembly.

See also, U.S. Pat. No. 6,338,211 (stake designed to hold a card); U.S. Pat. No. 5,678,289, (platform 50 slides out of the end cap of a casket to display media such as a CD); and U.S. Design Pat. D360,733; and D386,880.

The target stand of U.S. Pat. No. 4,913,389 can be driven into the ground with foot pressure on crossbar 14.

U.S. Pat. No. 5,207,402 a support frame for a sign has legs 16 and 18 that converge inwardly.

In U.S. Pat. No. 4,080,755 a marker can be imprinted with various planting instructions and plant descriptions. The lower end of the marker is triangular and the upper portion is rectangular. A charge of seeds 15 is contained behind tape 14 just above the triangular section. See also U.S. Pat. No. 3,908,308.

SUMMARY OF THE INVENTION

In accordance with the illustrative embodiments demonstrating features and advantages of the present invention, there is provided a holder for memorial material. The holder includes a display panel with a front and rear surface, and an upper ledge attached to the display panel. The display panel has between the front surface and the rear surface a material space for the memorial material. The upper ledge is adapted to receive downward pressure of a magnitude sufficient to drive the display panel at least partially underground.

According to another aspect of the invention, a holder for memorial material also has a display panel with a front and rear surface. The display panel again has between the front and rear surface a material space for the memorial material. This display panel has right and left converging edges to facilitate at least partial burial of the display panel in response to downward pressure that is adequate to drive it at least partially underground.

In accordance with yet another aspect of the invention, a method for holding memorial material employs a display panel having an internal material space. The method includes the step of inserting the memorial material into the internal material space inside the display panel. Another step is pressing the display panel downwardly to drive it at least partially underground.

By employing holders and methods of the foregoing type, improved techniques are achieved for placing memorial materials at a site. In a preferred embodiment, a display panel is formed from a metal blade having between the front and rear surface a space for holding memorial materials. Preferably, the space is open on top to allow insertion of memorial materials such as pictures or messages. This preferred display panel has a transparent, leakproof window in front, allowing one to observe the memorial materials.

Preferably, an upper ledge is hinged to the top of the display panel and can be lifted to allow access to the space that can hold the memorial materials. After the materials are inserted, the upper ledge can be swung down to close the holding space. When closed, the upper ledge preferably rests on gusset plates secured to the front of the display panel. In the preferred embodiment, the ledge has a gasket to hermetically seal the holding space. The ledge is held closed by threading screws with Allen heads through the ledge and into the gusset plates. In one preferred embodiment, an Allen wrench is kept handy by being clipped to the underside of the upper ledge.

Once the memorial materials are inserted and sealed in place, the display panel can be driven into the ground by stepping on the upper ledge. Preferably, the display panel and ledge will be driven down far enough so that the device does not protrude sufficiently to interfere with lawn mowing. Also, the display panel will be relatively secure and unobtrusive so that accidental displacement or scattering of these memorial display panels is unlikely.

In some embodiments the upper ledge may have a receptacle for holding a flower or a flower vase. In still other embodiments, a sheath may be first driven into the ground and the display panel later inserted, scabbard-like, into the sheath. The sheath allows for easy removal of the display panel for the purpose of changing the memorial materials.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 1 is a front elevational view of a holder in accordance with principles and methods of the present invention;

FIG. 2 is a side elevational view of the holder of FIG. 1 partially buried underground and supporting an arrangement of flowers in a vase;

FIG. 3 is a top view of the holder of FIG. 1;

FIG. 4 is a bottom view of the upper ledge of FIG. 1;

FIG. 5 is a side, elevational, sectional view showing fragments of the holder of FIG. 1 in detail; and FIG. 6 is a side elevational view of a holder that is an alternate to that of FIG. 1 and which cooperates with a sheath that is shown partly in section.

DETAILED DESCRIPTION OF THE PREFERRED EMBODIMENTS

Referring to FIGS. 1–5, the illustrated holder for memorial material has a tapered display panel 10 with a front surface 12 and a rear surface 14. Panel 10 is in the form of a metal blade with converging right edge 16 and left edge 18, which edges both converge to a pointed tip 20. Most of display panel 10 is hollow due to the fact that it contains a thin cavity with a trapezoidal outline, herein referred to as an internal material space. It will be appreciated that the cavity can have different shapes in other embodiments. Material space 20 is open on top in order to receive memorial material 22 through top opening 24. This memorial material 22 can include photographs, cards, printed material, etc.

Material space 20 is bordered from behind by an integral metal partition 26 and in front by an integral metal partition 28. Partition 28 has a trapezoidal window opening 30. A transparent sheet 32 made of plastic, glass or other transparent substances covers opening 30 to provide a window into material space 20. Transparent sheet 32 is sealed to the inside surface of partition 28 by means of glue, caulk, a gasket, or other means to prevent infiltration of fluids into material space 20.

While the illustrated display panel is preferably 10 inches long, 6 inches wide, and ¾ inch thick (25.4 cm×15.2 cm×1.9 cm), preferred embodiments can have dimensions that are between twice and half those dimensions.

An upper ledge 34 in the form of a metal plate is attached to the rear surface 14 of display panel 10 by means of hinges 36. Ledge 34 can swing down and rest atop reinforcing members 38, which are triangular metal gusset plates that are welded at the two upper corners of the front surface 12 of display panel 10 to project outwardly. A gasket 39 is glued to the underside of ledge member 34 to seal the top opening 24 when ledge member 34 is swung down into the closed position shown in FIG. 2.

Upper ledge member 34 can be fastened to reinforcing members 38 by means of a pair of fasteners 40, which may be Allen head screws, although other types of fasteners are possible. To facilitate fastening and unfastening of ledge 34, an Allen wrench 41 is attached to the underside of ledge 34 by means of a pair of clips 43, shown in the form of a pair of spaced loops, although other types of clipping means are anticipated.

The top surface of ledge member 34 has a recessed region 42 that is intended to carry a legible memorial marking such as an epitaph, or the name of a deceased person. This marking can be engraved, printed, or painted. The marking can also be made by means of a stencil, decal, screen or other means. Preferably however, the memorial marking is in the form of raised lettering created by movable font type 44. For example, the holder can be provided as a kit with a number of molded letters. A user can select the letters needed to spell a deceased's name or a desired epitaph. The selected letters can be secured inside recessed region 42 using an adhesive backing previously placed on the selected letters. In other embodiments the raised letters may have rear pins that fit into slots or other types of apertures formed in recessed region 42. In some embodiments the letters may be simple labels formed from thin sheet material or from plastic foam that is punched out in the shape of letters.

The two distal corners of ledge 34 each have a receptacle 46 in the form of a collar designed to hold one or more flower stems. Instead of holding stems directly, in some embodiments the funnel-shaped flower vase 48 can be inserted in receptacles 46. Thereafter flowers 50 can be inserted in vase 48.

Referring to FIG. 6, the illustrated display panel is similar to the one just described and for this reason corresponding components have the same reference numerals except raised by 100. Again, display panel 110 has an internal material space (not shown) for holding memorial materials. The ledge member 134 is attached to the rear surface of panel 110 by hinge 136. Ledge member 134 can swing down to close the internal space in panel 110 and rest atop reinforcing members 138. Members 138 are the same as previously mentioned members 38 except that the lower proximal corner 138 is formed into an abutment having a lower surface that is approximately perpendicular to the front surface of panel 110. Also, a bar 152 attached to the back of panel 110 running the width of panel 110 also acts has an abutment.

A sheath 54 having an outline similar to that of panel 110 but being slightly wider and about 25% longer is made of metal and is designed to be driven into the ground. Sheath 54 has a cavity 56 that is closed on all sides except for being open at the top edge of the sheath. The cavity 56 is designed to receive display panel 110 in a scabbard-like fashion. Display panel 110 slides into cavity 56 until the abutments 138A and 152 engage the top edge of sheath 54.

To facilitate an understanding of the principles associated with the foregoing apparatus, its operation will be briefly described. The illustrated holder is set up by first lifting ledge 34, loosening if necessary screws 40 with Allen wrench 41. With ledge 34 swung open as shown in FIG. 5, memorial materials 22 can be inserted into material space 20 through top opening 24. As previously mentioned, materials 22 may include photographs, cards, messages, printed material, or any other material a user may wish to insert. Thereafter, ledge 24 is swung down so that gasket 38 seals opening 24. Allen head screws 40 can be screwed through ledge 34 and into reinforcing members 38 using Allen wrench 41, which may be returned to clips 43 when done.

Also as previously described, raised letters 44 may be secured to the recessed region 42 to spell out an epitaph or the deceased's name.

Next, display panel 10 can be driven into the ground G at a gravesite or other site selected by the user. The panel 10 can be driven underground by applying pressure to ledge 34, which is reinforced from bending or breaking by reinforcing members 38. This downward force may be hand or foot pressure applied to the top of ledge 34. In some instances a rubber mallet may apply the downward force. In still other embodiments, display panel 10 may be inserted into a small excavation that is later backfilled.

When sufficient force is applied to ledge 34, pointed tip 20 penetrates ground G to a desired depth. Preferably, the depth of penetration brings ledge 34 so low that it does not interfere with lawn mowing. For example, ledge 34 will not rise any higher than 2 inches (3.1 cm). For many users the depth of penetration will be sufficient to bury window 30. This obscures the memorial material 22 normally visible through window 30, keeping this material relatively private. Also, a relatively deep insertion gives the user a sense of having brought the materials 22 close to a deceased that may be buried at the site.

Water or fluid intrusion will not destroy the memorial materials 22 even though they are underground, because the material space 20 is hermetically sealed by virtue of gasket 39 and the fact that transparent window material 32 is sealed to partition 28 to prevent fluid intrusion through window opening 30.

Display panel 10 may be left in place long-term. The body of display panel 10 may be made of a non-rusting metal such as aluminum or stainless steel to prevent corrosion and destruction of the panel. In some embodiments panel 10 may be coated with a rust inhibiting paint or plastic coating to maintain the panel's integrity.

A user may now insert one or more flowers into one or more of the receptacles 46. Alternatively, the stem of a funnel-shape vase 48 can be inserted into receptacles 46 and filled with flowers 50. Thus, flowers can be periodically replaced without the need to disturb display panel 10.

If the user wishes to replace the materials 22, display panel can either be left in place underground or removed. In any event, Allen wrench 41 is removed from clips 43 and used to loosen Allen screws 40. The ledge 34 is then lifted to open the material space 20. The original materials 22 can be removed through top opening 24 and replaced with substitute materials. Thereafter, ledge 34 can be closed and refastened as described previously.

It is appreciated that various modifications may be implemented with respect to the above described, preferred embodiments. While the transparent window material is shown as a simple sheet, in some embodiments the window material may be molded and have an plateau that protrudes snugly through window opening 30. Moreover, the window material may be mounted on the outside in some embodiments. Also, the window material can be tinted or decorated with appropriate printed markings. In some embodiments no window will be provided at all. Also, display panel 10 need not be flat, and in some embodiments may curve cylindrically or conically along a vertical axis in order to stiffen the panel. Moreover, the bottom of the display panel need not have a pointed tip and may instead be curved and blunt or may have multiple points. The upper ledge can overhang the front, the back, or both the front and back of the display panel. In some embodiments the ledge will be permanently affixed to the display panel and will not swing. In those instances memorial material can be placed inside the display panel through a side opening, or an opening in the ledge member. Alternatively, one can remove the transparent window material to gain access, or by any other means of opening the display panel. Furthermore, some embodiments will not employ a ledge at all. Instead, the upper portions of the display panel can be made sufficiently substantial to allow one to drive at least a portion of the display panel underground. For example, in some embodiments the display panel will have a wedge shape. Also, the various dimensions, proportions, and shapes disclosed herein can be vary depending on the desired size and structural integrity, or for aesthetic reasons. Also, the holder can be made from various metals, plastics, ceramics or other material having satisfactory strength and durability.

Obviously, many modifications and variations of the present invention are possible in light of the above teachings. It is therefore to be understood that within the scope of the appended claims, the invention may be practiced otherwise than as specifically described.

What is claimed is:

1. A holder for memorial material comprising:

a display panel having a front surface and a rear surface; and an upper ledge attached to said display panel, said display panel having between said front surface and said rear surface a material space for the memorial material, said front surface having a window made of a transparent substance to permit viewing into said material space, said upper ledge being adapted to receive downward pressure of a magnitude sufficient to drive said display panel at least partially underground.

2. A holder according to claim 1 wherein said display panel is tapered to facilitate driving of said display panel into the ground.

3. A holder according to claim 1 wherein said display panel has right and left edges that converge to facilitate driving of said display panel into the ground.

4. A holder according to claim 3 wherein the right and left edges of said display panel converge to a pointed tip.

5. A holder according to claim 1 wherein said upper ledge overhangs said window.

6. A holder according to claim 1 wherein said display panel is adapted to be driven underground to a depth sufficient to cover said window.

7. A holder according to claim 1 wherein said display panel is adapted to be driven underground to a depth sufficient to avoid interference with a lawn mower.

8. A holder according to claim 1 wherein said front and said rear surface are peripherally joined to form an enclosure with a top opening.

9. A holder according to claim 8 wherein said upper ledge overlays said top opening.

10. A holder according to claim 9 wherein said upper ledge is hinged to said display panel.

11. A holder according to claim 10 wherein said upper ledge can be swung up and down to open and close, respectively, said top opening.

12. A holder according to claim 11 comprising:

a gasket mounted under said upper ledge to cover and seal said top opening.

13. A holder according to claim 12 comprising:

a reinforcing member mounted on said panel to project outwardly and provide underlying support for said upper ledge.

14. A holder according to claim 13 comprising:

a fastener for fastening said upper ledge to said reinforcing member.

15. A holder according to claim 1 wherein said upper ledge comprises:

a receptacle for holding at least one flower.

16. A holder according to claim 1 comprising:

a flower vase, said upper ledge having a receptacle for holding said flower vase.

17. A holder for memorial material comprising:

a panel having a front surface and a rear surface; and an upper ledge attached to said panel, said panel having between said front surface and said rear surface a material space for the memorial material, said upper ledge being adapted to receive downward pressure of a magnitude sufficient to drive said panel at least partially underground, said upper ledge being hinged to said rear surface.

18. A holder for memorial material comprising:

a panel having a front surface and a rear surface:

an upper ledge attached to said panel, said panel having between said front surface and said rear surface a material space for the memorial material, said upper ledge being adapted to receive downward pressure of a magnitude sufficient to drive said panel at least partially underground;

a reinforcing member mounted on said panel to project outwardly and provide underlying support for said upper ledge;

a fastener for fastening said upper ledge to said reinforcing member; and a clip mounted under said upper ledge for holding a tool for fastening and unfastening said fastener.

19. A holder for memorial material comprising:

a panel having a front surface and a rear surface; and an upper ledge attached to said panel, said panel having between said front surface and said rear surface a material space for the memorial material, said upper ledge being adapted to receive downward pressure of a magnitude sufficient to drive said panel at least partially underground, said upper ledge having a legible memorial marking.

20. A holder according to claim 19 wherein said upper ledge has recessed region containing the legible memorial markings in the form of raised lettering.

21. A holder according to claim 20 comprising a plurality of movable type fonts, a selected number of said movable type fonts being arranged and secured in said recessed region to form the legible memorial markings into a person's name.

22. A holder for memorial material comprising:

a panel having a front surface and a rear surface;

an upper ledge attached to said panel, said panel having between said front surface and said rear surface a material space for the memorial material, said upper ledge being adapted to receive downward pressure of a magnitude sufficient to drive said panel at least partially underground; and a sheath sized to releasably hold said panel, said sheath being adapted to be driven at least partially underground, so that said panel can be removed and reinstalled by withdrawal from and insertion into said sheath.

23. A method for holding memorial material with a display panel having an internal material space and a window for viewing the internal material space, comprising the steps of:

inserting said memorial material into said internal material space inside said display panel; and pressing said display panel downwardly to drive said display panel at least partially underground and said window underground.

24. A method according to claim 23 wherein the step of pressing said display panel downwardly is performed at a gravesite.

25. A method according to claim 23 wherein the step of pressing said display panel downwardly is performed by foot.

26. A method according to claim 23 wherein the step of pressing said display panel downwardly is performed to drive most of said display panel underground.

27. A method for holding memorial material with a panel having an internal material space and an upper ledge, the method comprising the steps of:

making a legible memorial marking atop said upper ledge;

inserting said memorial material into said internal material space inside said panel; and pressing said panel downwardly to drive said panel at least partially underground.

28. A method according to claim 27 wherein the step of making a legible memorial marking is performed by arranging and securing movable type fonts on said upper ledge.

29. A method according to claim 28 wherein the step of making a legible memorial marking is performed by arranging the movable type fonts into a person's name.

30. A method according to claim 27 wherein the internal material space is open on top, the method including the step of:

closing the internal material space with an upper ledge member.

31. A method according to claim 30 wherein step of closing the internal material space is performed by releasably fastening the upper ledge member to the panel, allowing the upper ledge member to overhang the panel.

32. A method according to claim 27 comprising the step of:

securing at least one flower to the panel.

33. A method for holding memorial material with a panel having an internal material space, comprising the step of:

inserting said memorial material into said internal material space inside said panel;

pressing said panel downwardly to drive said panel at least partially underground;

planting a sheath in the ground;

inserting said panel in said sheath; and removing said panel from said sheath in order to replace said memorial material in said internal material space.

* * * * *